US006168397B1

(12) United States Patent
Iwata

(10) Patent No.: US 6,168,397 B1
(45) **Date of Patent: *Jan. 2, 2001**

(54) FLEXIBLE TUBE OF SQUEEZE PUMP

(75) Inventor: Noboru Iwata, Hashima (JP)

(73) Assignee: Daiichi Techno Co., Ltd.(JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/886,677

(22) Filed: Jul. 1, 1997

(51) Int. Cl.[7] ..... F04B 43/18
(52) U.S. Cl. ..... 417/477.12; 417/900
(58) Field of Search ..... 417/477.12, 477.3, 417/900

(56) References Cited

U.S. PATENT DOCUMENTS

| | | | | |
|---|---|---|---|---|
| 4,000,759 | | 1/1977 | Higbee . | |
| 4,110,061 | * | 8/1978 | Gerritsen | 417/477.12 |
| 4,492,538 | | 1/1985 | Iwata . | |
| 4,632,646 | * | 12/1986 | Iwata | 417/900 |
| 4,730,933 | | 3/1988 | Lohr . | |
| 4,730,993 | * | 3/1988 | Iwata | 417/900 |
| 5,533,878 | * | 7/1996 | Iwata | 417/477.3 |

FOREIGN PATENT DOCUMENTS

| | | |
|---|---|---|
| 0 075 020 | 6/1982 | (EP) . |
| 2 084 287 | 4/1982 | (GB) . |
| 47 - 11744 | 6/1972 | (JP) . |
| 57 - 210194 | 12/1982 | (JP) . |
| 62 - 157286 | 7/1987 | (JP) . |
| 64 - 29428 | 11/1989 | (JP) . |
| 6 - 1789 | 11/1994 | (JP) . |
| 7 - 189925 | 7/1995 | (JP) . |

* cited by examiner

*Primary Examiner*—Charles G. Freay
(74) *Attorney, Agent, or Firm*—Ackerman Senterfitt

(57) ABSTRACT

A squeeze type pump that transfers slurry via an elastic tube by squeezing the elastic tube with pairs of rollers to elastically deform the tube by moving each pair of squeezing rollers. The elastic tube has an outer diameter, an inner diameter, and a thickness. A ratio of the inner diameter to the outer diameter is set within a range of 0.56 to 0.72, and the thickness is set within a range of 23 to 35 mm.

15 Claims, 10 Drawing Sheets

FLEXIBLE TUBE OF SQUEEZE PUMP

BACKGROUND OF THE INVENTION

The present invention relates to a squeeze type pump, which transfers slurry such as freshly mixed concrete, and more particularly, to an elastic tube preferably used for a squeeze type pump having squeezing rollers, which squeeze the elastic tube to elastically deform the tube and transfer slurry via the elastic tube.

Prior art squeeze type pumps include an elastic tube, which is arranged in a U-shaped manner along the inner surface of a cylindrical drum. A pair of support arms are mounted on a drive shaft that is inserted through a center of the drum. The support arms are separated from each other by an angle of 180 degrees and rotated synchronously. A pair of squeezing rollers are supported at a distal portion of each support arm by means of a support shaft and a bearing. The rollers squeeze the elastic tube from each side of its outer surface to elastically deform the tube into a flat shape.

The pairs of squeezing rollers squeeze the elastic tube to move concrete that is in front of the rollers through the tube along the revolving direction of the rollers. Furthermore, the succeeding pair of rollers revolve and squeeze the elastic tube to move concrete sealed within the tube, between the preceding rollers and the succeeding rollers, in the revolving direction of the rollers. Concrete is thus pumped.

However, in the prior art squeeze type pumps, which have an elastic tube that has a certain dimension, the elastic tube 61 is pressed against the inner surface of a drum 63 when the squeezing rollers 62 start to squeeze the tube 61, as shown in FIG. 14 by the solid line. This prevents the tube 61 from being located in a normal position, as shown in FIG. 14 by the broken line. In such cases, it is necessary to replace the elastic tube or adjust the attachment position of the squeezing rollers. This reduces operation efficiency.

Furthermore, if these problems frequently occur, the elastic tube becomes worn in some locations, and the durability of the tube is reduced.

In addition, experiments show that the above problems occur with elastic tubes that have specific dimensions. As shown in Table 2, which will be described later, such elastic tubes have outer diameters ranging from 160 to 165 mm, inner diameters ranging from 120 to 145 mm, and thickness ranging from 7.5 to 22.5 mm. In such cases, the ratio of the inner diameter of the tube to the outer diameter thereof ranges from 0.73 to 0.91.

SUMMARY OF THE INVENTION

Accordingly, it is an objective of the present invention to provide a squeeze type pump having an elastic tube that is always located in a normal position between squeezing rollers when the rollers start to squeeze the elastic tube.

Furthermore, it is another objective of the present invention to provide an elastic tube used for a squeeze type pump capable of preventing local wear of the tube and improving the durability thereof.

A squeeze type pump according to the present invention transfers slurry via an elastic tube by squeezing the elastic tube with pairs of rollers to elastically deform the tube by moving each pair of squeezing rollers. The elastic tube includes an outer diameter, an inner diameter, and a thickness. A ratio of the inner diameter to the outer diameter is set within a range of 0.56 to 0.72, and the thickness is set within a range of 23 to 35 mm. It is assured that the elastic tube according to the present invention is thus squeezed while the tube is in the normal position. The local wear of the elastic tube is then prevented.

BRIEF DESCRIPTION OF THE DRAWINGS

The features of the present invention that are believed to be novel are set forth with particularly in the appended claims. The invention, together with objects and advantages thereof, may best be understood by reference to the following description of the presently preferred embodiments together with the accompanying drawings in which:

DETAILED DESCRIPTION Of THE PREFERRED EMBODIMENTS

A first embodiment of a squeeze type pump according to the present invention will now be described with reference to FIGS. 1 to 12.

Figure 6:
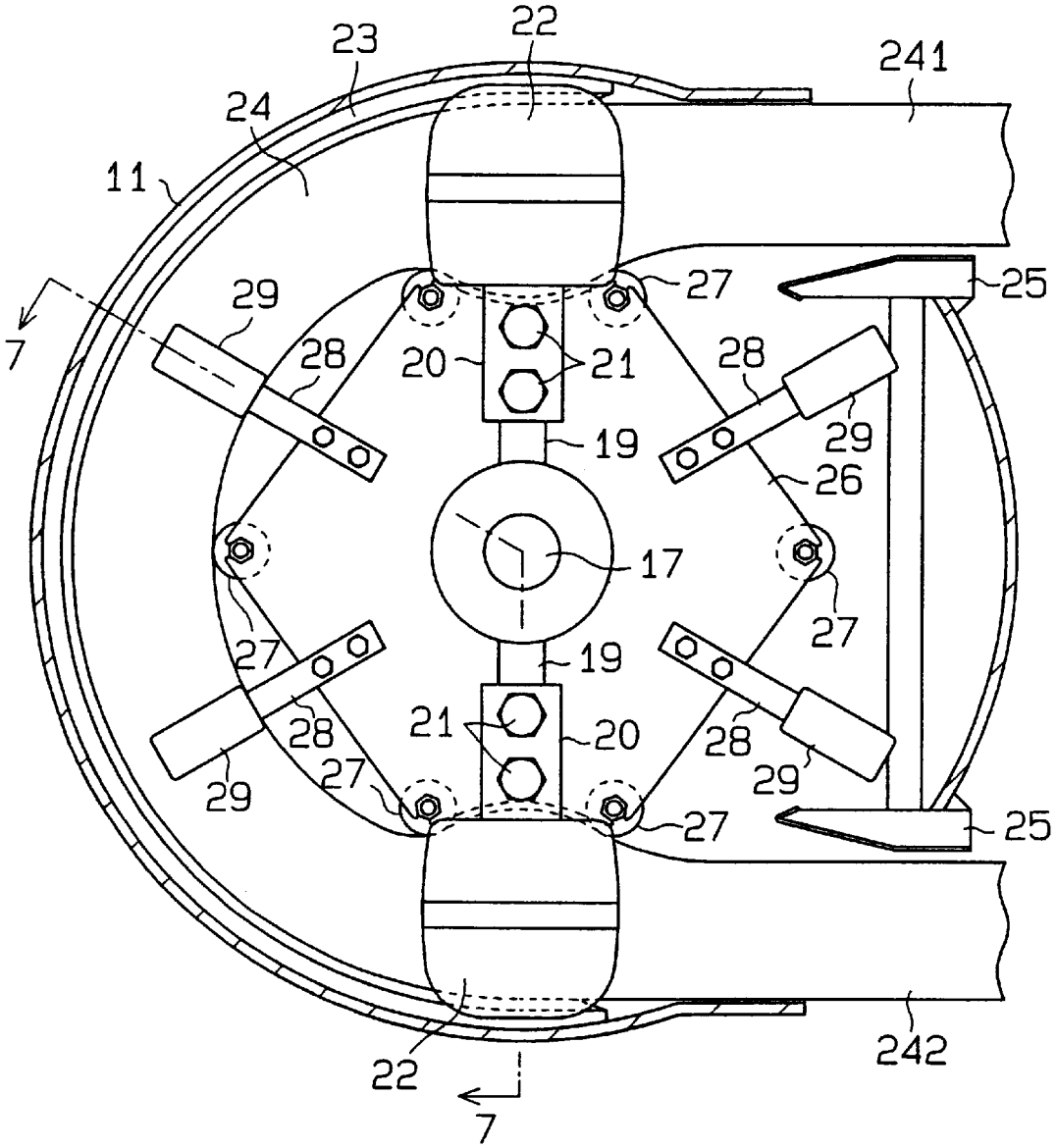
FIG. 6 is a side view showing the squeeze type pump.
Figure 7:
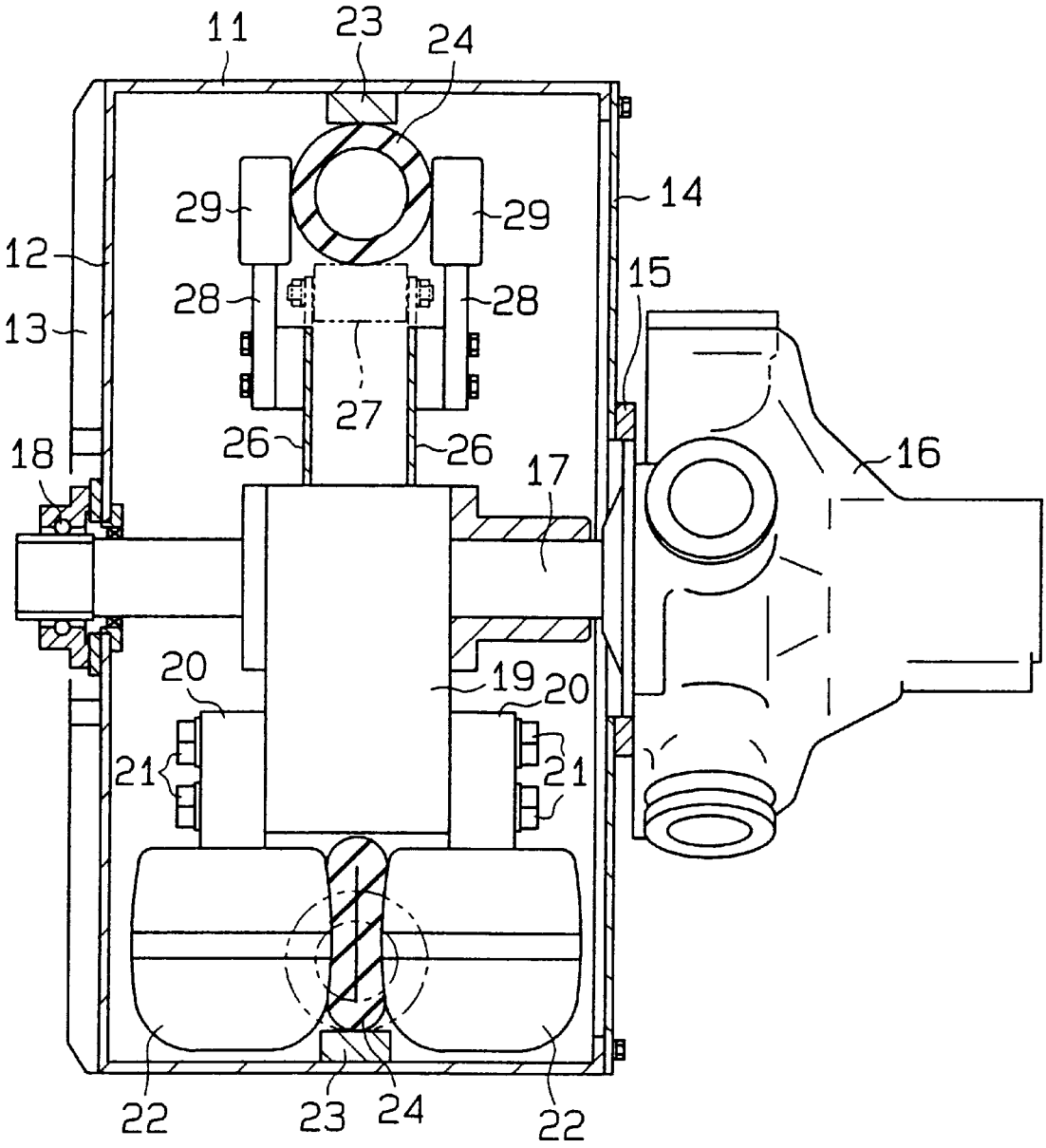
FIG. 7 is a cross-sectional view of the squeeze type pump taken along line 7—7 in FIG. 6.
Figure 8:
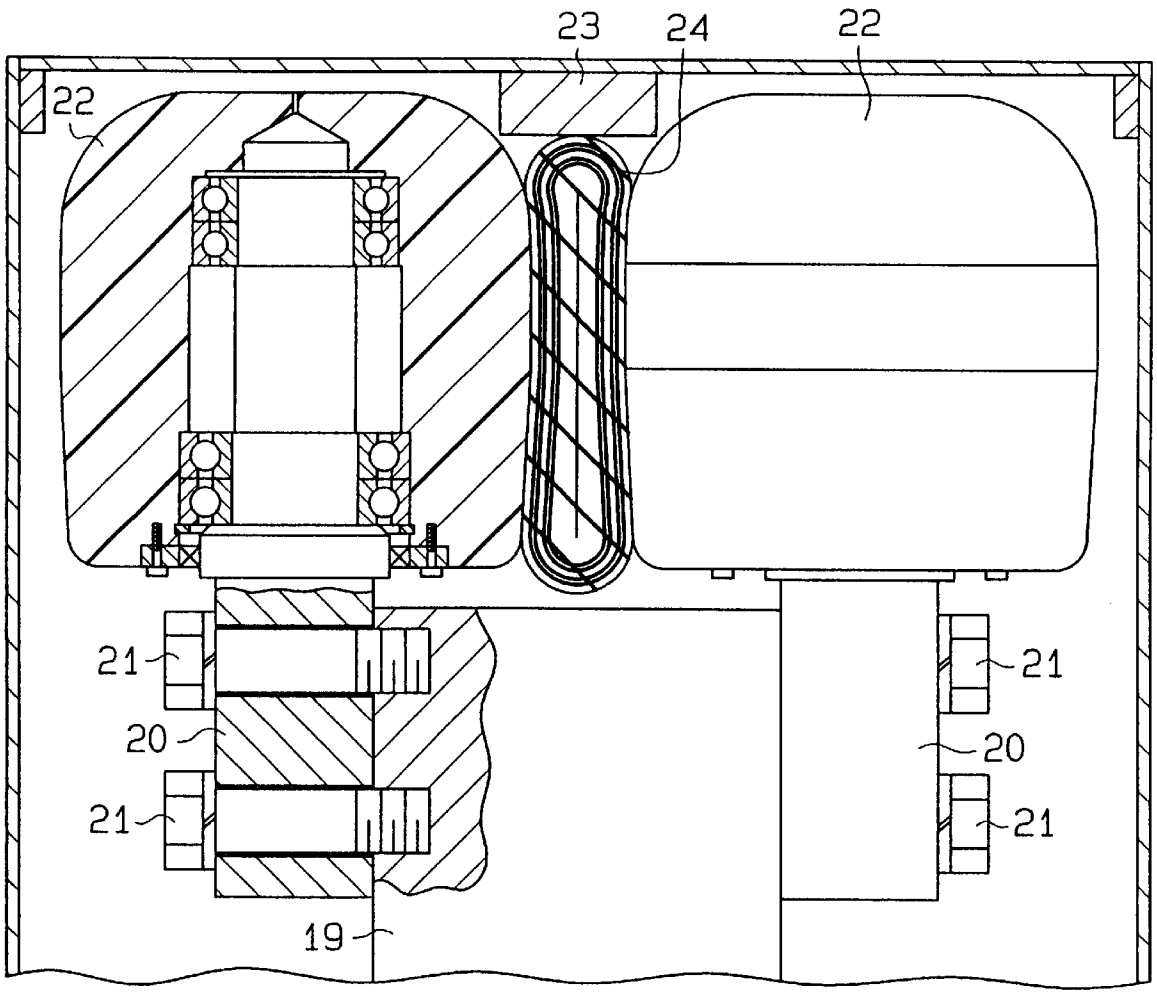
FIG. 8 is a partial cross-sectional view showing the elastic tube squeezed by the squeezing rollers.

The entire structure of the squeeze type pump will now be described. As shown in FIGS. 6 and 7, a cylindrical drum 11 is fixed to a vehicle (not shown), which transports the squeeze type pump. As shown in FIG. 7, a side plate 12 is formed integrally with a left end portion of the drum 11. A reinforcing rib 13 is welded to the outer surface of the side plate 12. A cover plate 14 is secured to the right end portion of the drum 11 by bolts to cover an opening. An attachment plate 15 secures a hydraulic motor 16, which is inserted in an opening defined at the center of the cover plate 14. The motor 16 includes a drive shaft 17, which extends through a center portion of the drum 11. A distal portion of the drive shaft 17 is supported by a center portion of the side plate 12 by a radial bearing 18.

As shown in FIG. 6, a pair of straight support arms 19 are coupled to a middle portion of the drive shaft 17. The support arms 19 are separated from each other by an angle of 180 degrees. As shown in FIG. 7, a pair of support shafts 20, which extends parallel with each other, are fastened to each side of a distal portion of each support arm 19 by bolts 21. A squeezing roller 22 is rotatably supported by each support shaft 20 to squeeze an elastic tube 24.

A substantially semicircular supporter 23 is fixed, for example, by means of welding, to the inner surface of the drum 11. The elastic tube 24 is arranged along the inner surface of the supporter 23. As shown in FIG. 6, the elastic tube 24 includes an inlet portion 241, which extends horizontally from an upper part of the drum 11. The inlet portion 241 is connected to a concrete hopper (not shown) by a suction piping. An outlet portion 242 of the elastic tube 24 extends horizontally from a lower part of the drum 11 and is connected to a discharge piping. Concrete is thus provided to a construction site. A guide member 25 guides the elastic tube 24.

A pair of polygonal attachment plates 26 are mounted on the drive shaft 17. The attachment plates 26, which extend parallel to each other, are arranged in the axial direction of the drive shaft 17 with a predetermined interval therebetween. The attachment plates 26 are welded to the drive shaft 17. Rollers 27 are rotatably supported by opposing corner portions of the attachment plates 16 to contact the inner side of the elastic tube 24 and restore the cylindrical shape of the flattened tube.

A plurality of opposing support arms 28 are attached to the outer surface of each attachment plate 26. A restricting roller 29 is rotatably supported by each arm 28 for restricting the position of the outer surface of the elastic tube 24.

In the squeeze type pump of this embodiment, as shown in FIG. 7, the drive shaft 17 of the motor 16 rotates to cause integral revolution of the support arms 19, the squeezing rollers 22, the restoring rollers 27, and the position restricting rollers 29. Each pair of squeezing rollers 22 compresses the elastic tube 24 into a flat shape and revolves about the shaft 17. This moves concrete located in front of the rollers 22 from the inlet portion 241 toward the outlet portion 242. The concrete is thus transferred from a supply source to a desired location.

Figure 1:
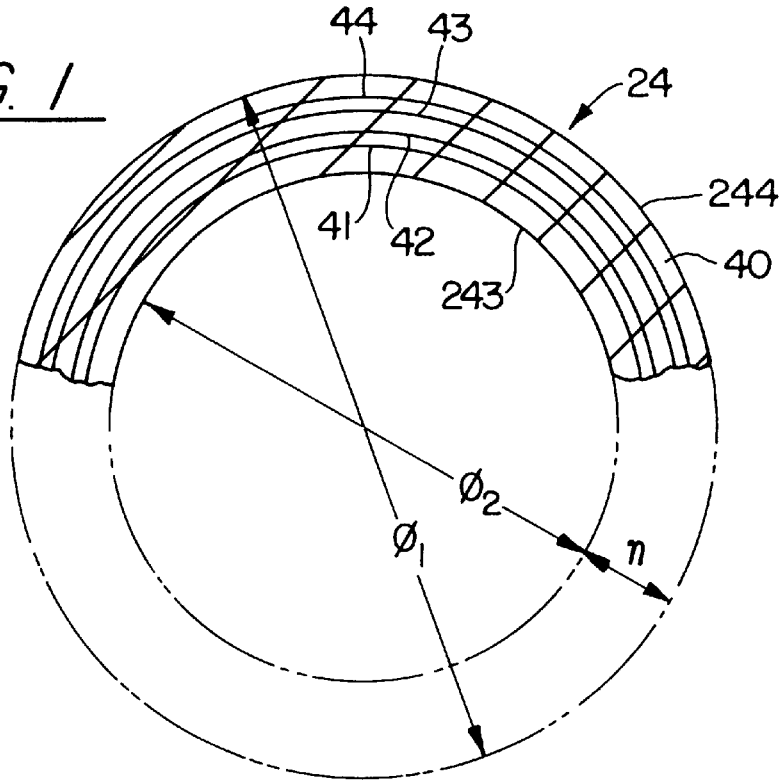
FIG. 1 is a partial cross-sectional view showing an elastic tube.
Figure 2:
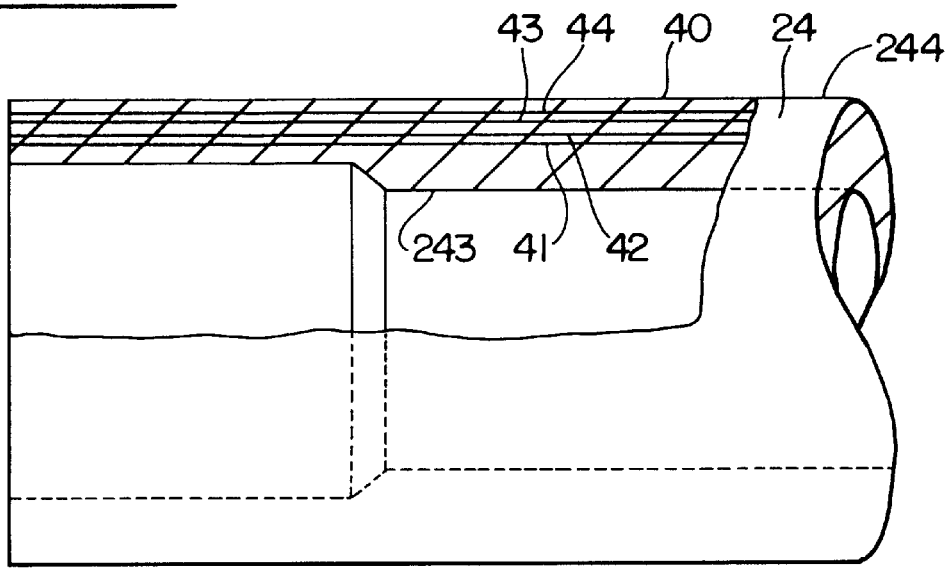
FIG. 2 is a partial side cross-sectional view showing the elastic tube as viewed in the same direction as FIG. 1.

The structure of the elastic tube 24 will now be described. As shown in FIGS. 1 and 2, the elastic tube 24 includes a cylindrical tube body 40, which is formed from rubber, and first, second, third, and fourth reinforcing layers 41, 42, 43, 44. The first to fourth reinforcing layers 41 to 44 are embedded concentrically in the body 40. The tube body 40 is formed from wear resistant and weather resistant rubber, which has, for example, the composition shown in Table 1.

TABLE 1

| Element | Content (Parts by weight) |
|---|---|
| Natural rubber | 50 |
| Styrene-butadiene rubber | 50 |
| Carbon black | 50 |
| Zinc white | 5 |
| Softener | 5 |
| Processing aid | 3 |
| Sulfur | 2 |
| Vulcanization accelerator | 1 |
| Stearic acid | 2 |
| Antioxidant | 1 |

Figure 3:
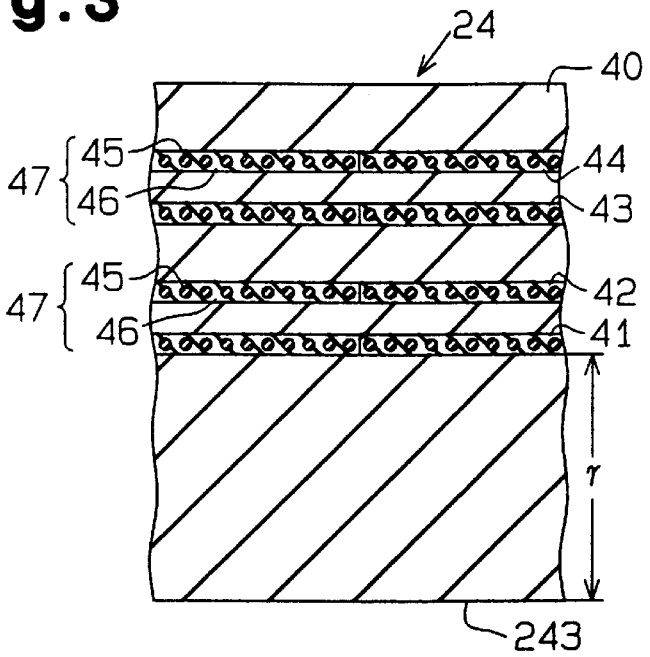
FIG. 3 is a partial enlarged cross-sectional view showing the elastic tube.

As shown in FIG. 3, the reinforcing layers 41 to 44 are constituted by elongated synthetic fiber belts 47. Each synthetic fiber belt 47 includes a plurality of nylon threads 45 and rubber 46, which encompasses the nylon threads 45. The nylon threads 45 lie parallel in the plane of each belt with an interval between one another. The nylon threads 45 are formed from nylon 6 or nylon 66, while the rubber 46 is formed from natural rubber or styrene-butadiene rubber.

The thickness of each synthetic fiber belt 47 is set within a range of 0.6 to 1.2 mm, while its width is set within a range of 200 to 500 mm, preferably within a range of 300 to 400 mm. The synthetic fiber belts 47 of the first and the second reinforcing layers 41, 42 extend helically about the axis of the tube in a first direction and in a second, opposite direction, respectively. In the same manner, the synthetic fiber belts 47 of the third and the fourth reinforcing layers 43, 44 extend helically in opposite directions.

Figure 5:
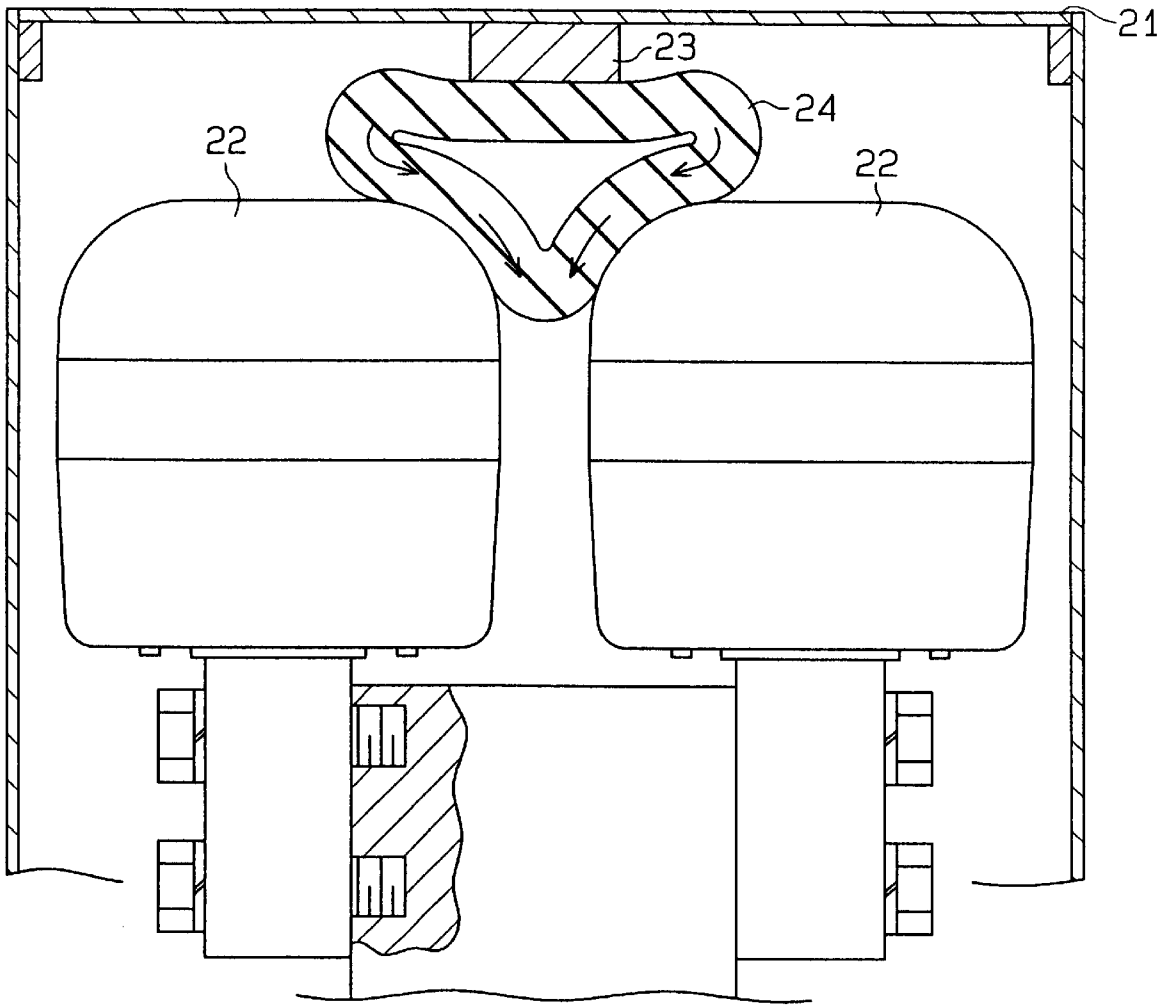
FIG. 5 is a partial cross-sectional view showing the elastic tube in an initial squeezing state.

As shown in FIG. 1, the dimension ratio of the diameter of the outer surface 244 (hereinafter referred to as outer diameter $\Phi_1$) and the diameter of the inner surface 243 (hereinafter referred to as inner diameter $\Phi_2$) of the elastic tube 24 ($\Phi_2/\Phi_1$) is set within a range of 0.56 to 0.72. The elastic tube 24 is thus squeezed in an optimal manner, as shown in FIG. 5, during an initial period of squeezing by the squeezing rollers 22. The basis for selecting the dimension ratio will hereafter be described.

An experiment was performed using a first elastic tube and a second elastic tube to move concrete therethrough. The first elastic tube had an outer diameter $\Phi_1$ set at 159.0 mm, and an inner diameter $\Phi_2$ set at 101.6 mm. The second elastic tube had an outer diameter $\Phi_1$ set at 165.0 mm, and an inner diameter $\Phi_2$ set at 105.0 mm. In the experiment, each elastic tube was squeezed in an optimal manner by the squeezing rollers (see Table 2). Furthermore, in third to sixth elastic tubes, the outer diameter $\Phi_1$ of the elastic tube was set at either 159.0 mm or 165.0 mm with the thickness $\eta$ of the elastic tube 24 set within a range of 23.0 mm to 35.0 mm. In such cases, the elastic tube was also squeezed in an optimal manner.

TABLE 2

| Tube No. | Outer diameter $\phi_1$ mm | Inner diameter $\phi_2$ mm | Thickness $\eta$ mm | Dimension ratio $\phi_2/\phi_1$ | Feasibility |
|---|---|---|---|---|---|
| 1 | 159.0 | 101.6 | 28.7 | 0.64 | Feasible |
| 2 | 165.0 | 105.0 | 30.0 | 0.64 | Feasible |
| 3 | 159.0 | 113.0 | 23.0 | 0.71 | Feasible |
| 4 | 159.0 | 89.0 | 35.0 | 0.56 | Feasible |
| 5 | 165.0 | 119.0 | 23.0 | 0.72 | Feasible |
| 6 | 165.0 | 95.0 | 35.0 | 0.58 | Feasible |
| 7 (Prior art) | 165.0 | 120.0 | 22.5 | 0.73 | Unfeasible |
| 8 (Prior art) | 165.0 | 145.0 | 10.0 | 0.88 | Unfeasible |
| 9 (Prior art) | 160.0 | 120.0 | 20.0 | 0.75 | Unfeasible |
| 10 (Prior art) | 160.0 | 145.0 | 7.5 | 0.91 | Unfeasible |

Therefore, the dimension ratio ($\Phi_2/\Phi_1$) of the elastic tube is preferably set within a range of 0.56 to 0.72. More preferably, the dimension ratio ($\Phi_2/\Phi_1$) is set within a range of 0.60 to 0.68. The thickness $\eta$ of the elastic tube is preferably set within a range of 23 to 35 mm, and more preferably, within a range of 28.7 to 30.0 mm.

If the thickness $\eta$ of the elastic tube 24 exceeds 35 mm, the outer surfaces of the reinforcing layers 41, 42, 43, 44 may easily separate from the rubber body 40. If the thickness $\eta$ is smaller than 23 mm, the force for restoring the original shape of the flattened elastic tube 24 may be reduced. Furthermore, in such cases, heat may cause the outer surfaces of the layers 41, 42 to separate from the body 40.

Figure 4:
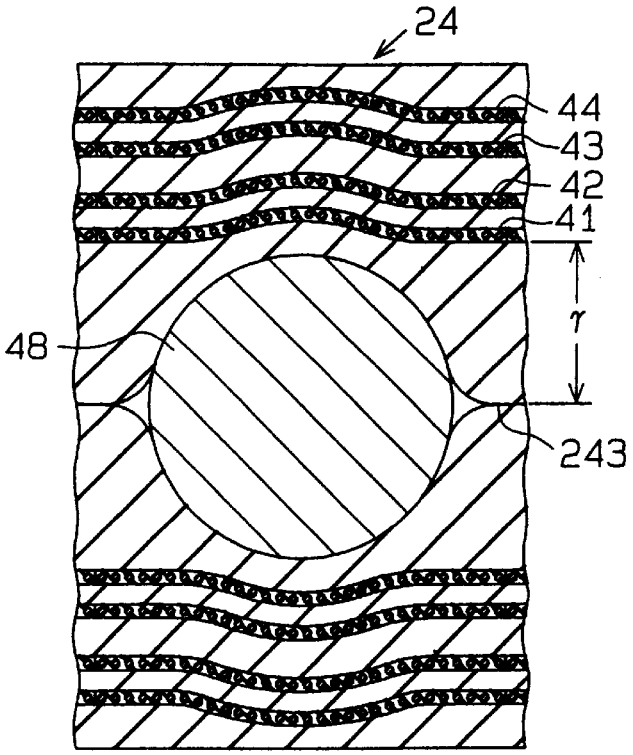
FIG. 4 is a partial cross-sectional view of the contacting walls of a squeezed and flattened tube showing a foreign body caught in the elastic tube as seen in the same direction as FIG. 1.

As shown in FIG. 3, the thickness $\gamma$ of a rubber layer, which is defined by the innermost reinforcing layer, or the first reinforcing layer 41 and the inner surface 243 of the tube 24, is set within a range of 10 to 15 mm. As shown in FIG. 4, the rubber layer prevents a foreign body 48 from cutting the first reinforcing layer 41 of the elastic tube 24 and the tube 24 is flattened by squeezing, when the foreign body 48 is caught in the tube 24.

Figure 9:
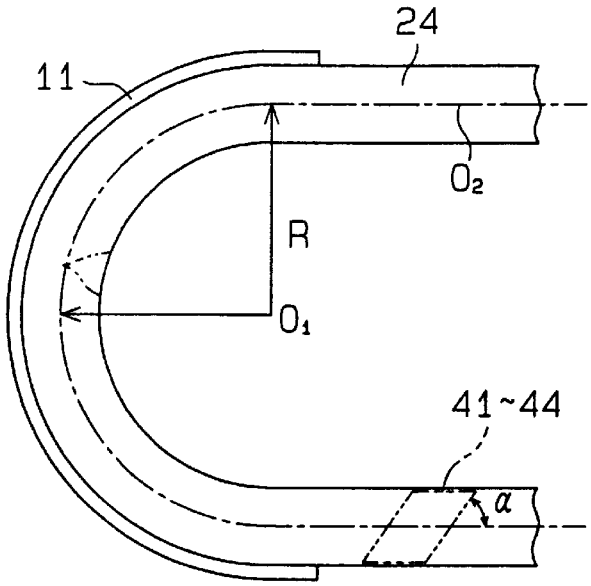
FIG. 9 is schematic side view showing the elastic tube arranged along the inner surface of a drum.

As shown in FIGS. 6 and 9, the elastic tube 24 of this embodiment is arranged in a semicircular shape along the inner surface of the drum 11. A bend radius R of the elastic tube 24, which is the distance from the center $O_1$ of the drum 11 to the axis $O_2$ of the elastic tube 24, is determined as follows.

Figure 10:
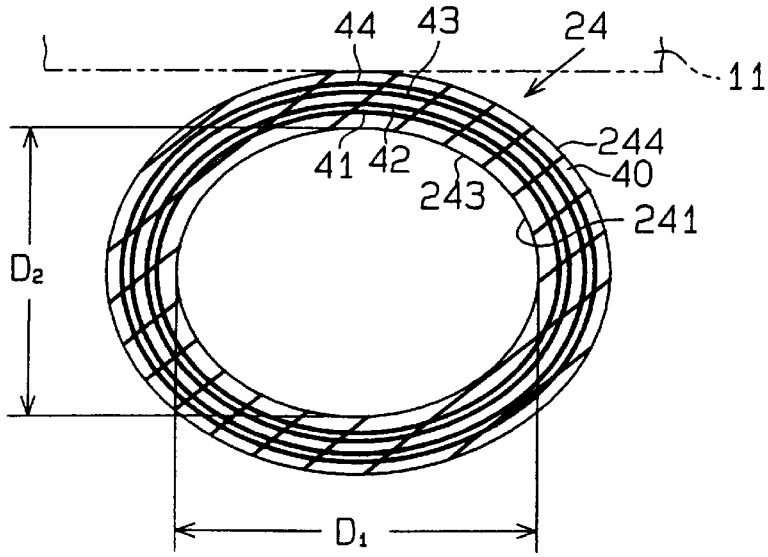
FIG. 10 is a cross-sectional view of the elastic tube when accommodated in the drum.

The elastic tube 24 has a circular cross section when it extends straight. However, the elastic tube 24 is deformed when a portion thereof is accommodated in the drum 11, as shown in FIG. 9. Then, as shown in FIG. 10, the elastic tube 24 has an oval cross section. In this state, a major axis $D_1$ of the inner surface 241 is parellel to the inner surface of the drum 11, and a minor axis $D_2$, extends perpendicular to the inner surface of the drum 11, as shown in FIG. 10. A ratio of the minor axis $D_2$ to the major axis $D_1$, or $[(D_2/D_1)\times 100]$ indicates a compression $\tau$ of the elastic tube. As the compression $\tau$ becomes smaller, the suction amount of the pump becomes smaller.

When the elastic tube 24 is curved as shown in FIG. 9, a tensile force acts on an outer side portion of the tube 24 that contacts the drum 11, while a compressive force acts on an inner side portion that is separated from the drum 11. The bend radius R then becomes smaller to reduce the compression $\tau$. If the elastic tube 24 is bent beyond its yielding point (restoration limit), a force acting on the elastic tube 24 becomes larger than the buckling resistance force T of the tube. This buckles the inner side portion of the elastic tube 24 as shown in FIG. 9 by the broken line.

In this embodiment, the compression $\tau$ of the elastic tube 24 is thus determined by the following equation so that a suction decrease corresponding to a compression decrease of the elastic tube 24 will be maintained under 10%, and the buckling of the tube will be prevented:

$$\tau=[(D_2/D_1)\times 100]\geqq 90\% \quad (1)$$

The bend radius R, the thickness $\eta$, the rigidity G, and the ratio of the inner diameter $\Phi_2$ to the outer diameter $\Phi_1(\Phi_2/\Phi_1)$ of the elastic tube 24 should be chosen to meet requirements of the equation (1). The rigidity G of the elastic tube 24 depends on the number N of the first to fourth reinforcing layers 41 to 44 and the winding angle a thereof (inclined angle of the layers 41 to 44 with respect to the axis $O_2$, as shown in FIG. 9), the thickness $\eta$ of the elastic tube 24, and hardness Hs of the rubber.

Figure 11:
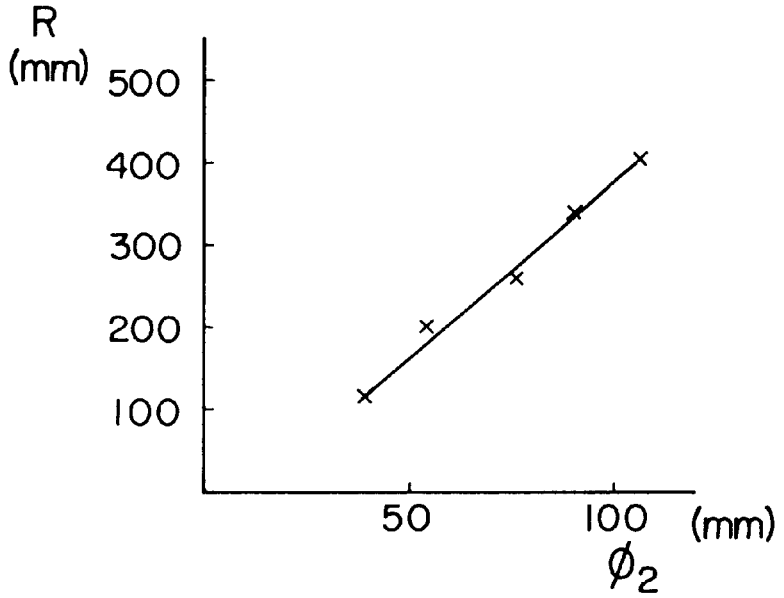
FIG. 11 is a graph showing the relation between the inner diameter of the elastic tube and the bend radius thereof.

An experiment was performed to determine a relation between the inner diameter $\Phi_2$ and the bend radius R of the elastic tube 24 in light of the equation (1). The results are shown in the graph of FIG. 11. As shown in this graph, a ratio of the bend radius R to the inner diameter $\Phi_2$, or $R/\Phi_2$ is approximately 4.0. However, $R/\Phi_2\approx 5.0$ is preferred to assure safety.

With the elastic tube 24 being bent in accordance with the bend radius R, an external force W (kg) acts on the tube 24 in a normal direction with respect to the axis of the tube 24. The circular cross section of the tube 24 is thus deformed into an oval shape. In this state, the elastic tube 24 applies force that resists the external force, or the buckling resistance force T (kg). When the external force W becomes larger than buckling resistance force T, the bend radius R corresponds to a buckling bend radius while the buckling force T corresponds to a limit buckling resistance force.

The buckling resistance force T is determined by the following equation (2), and the rigidity G of the elastic tube 24 is determined by the following equation (3):

$$T=k_1\times(\eta^n/\Phi_2^m)\times G^r \quad (2)$$

$$G=k_2\times N\times E \quad (3),$$

where $k_1$, $k_2$ are constants, indices n, m, r are values that are experimentally determined, N is the number of the reinforcing layers 41 to 44, and E is a constant that is determined experimentally based on the material of the reinforcing layers 41 to,44, the thickness of fiber of the layers, and the fiber density thereof (the number of fibers contained in an inch (2.54 cm)).

Furthermore, the winding angle $\alpha$ of the reinforcing layers 41 to 44 affects the curvature characteristics of the tube 24. If the winding angle $\alpha$ is zero, the tube is hard to bend and easy to buckle. However, the tube is not easily stretched axially by pressure acting in the tube. If the winding angle $\alpha$ is 90 degrees, the tube is easy to bend and hard to buckle. However, the tube is easily stretched axially by pressure acting in the tube. Therefore, the winding angle $\alpha$ is set normally within a range of 50 to 70 degrees, and preferably within a range of 50 to 60 degrees. In this embodiment, the winding angle $\alpha$ is set to be 54'55". This structure enables a balance between the axial component and the radial component of the force acting on the tube.

Figure 12:
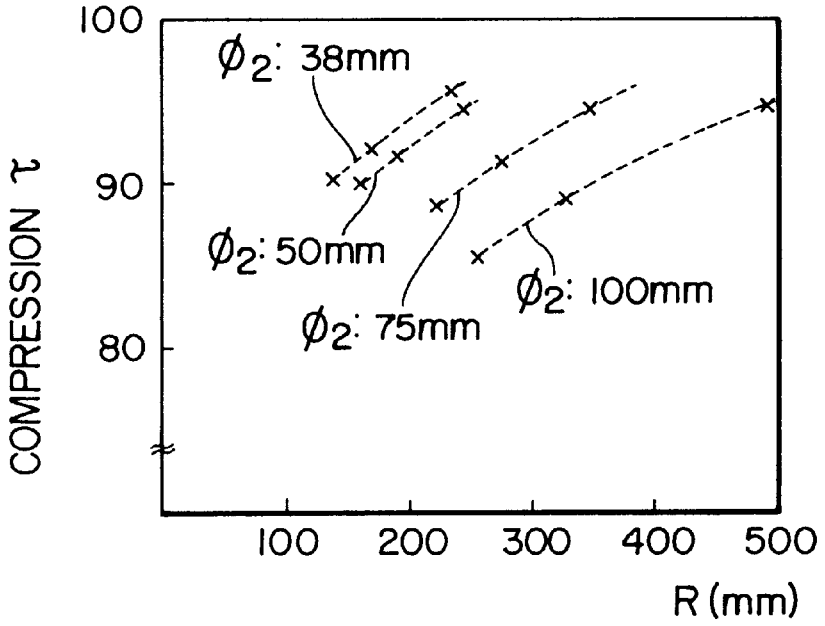
FIG. 12 is a graph showing the relation between the bend radius of the elastic tube and the compression thereof.

A plurality of elastic tubes 24, inner diameters $\Phi_2$ of which are 38, 50, 75, and 100 mm, were produced to determine relations between the bend radius R and the compression $\tau$ of each tube 24. The results are shown in FIG. 12. The bend radius R of the elastic tube is obtained in accordance with the graph shown in FIG. 12 and is represented by the following equation (4):

$$R=k_3\times(\Phi_2+\eta)\times(\Phi_2/\eta) \quad (4),$$

$$\text{where } k_3\ (1/G) \quad (5).$$

If the value of N, or the number of the reinforcing layers 41 to 44, increases in the equation (3), the rigidity G represented in the equations (3), (5) becomes larger. This reduces the value of constant $k_3$ represented in the equations (4), (5). If the constant $k_3$ is smaller, the bend radius R determined by the equation (4) becomes smaller, even though the thickness $\eta$ of the tube 24 and the compression $\tau$ thereof are constant. The hardness Hs of the rubber, which is related to the rigidity G, is set normally within a range of 50 to 70 degrees. Furthermore, the constant $k_3$ varies in accordance with the diameter of the drum 11, and is set normally within a range of 0.8 to 1.2.

A plurality of elastic tubes, nominal diameters of which are 38, 50, 75, and 100 mm, were designed and produced to have a compression $\tau$ determined by the equation (1) and in accordance with the experimental equation (4). Table 2 shows calculated values and actual values of the bend radius R of the elastic tubes 24 and actual values of the compression $\tau$ of the elastic tubes 24. The inner surface of the drum 11 has a radius that is determined by adding a half value of the outer diameter $\Phi_1$ of the elastic tube to the actual value of the bend radius R.

TABLE 3

| | Data of the tubes | | | Bend radius R | | |
|---|---|---|---|---|---|---|
| Nominal Diameter $\phi_2$ (mm) | Inner diameter $\phi_2$ | Thickness $\eta$ | Number of reinforcing layers | Calculated value | Actual value | Compression $\tau$ (%) |
| 38 | 38.1 | 12.7 | 4 | 152.4 $k_3$ | 128.3 | 92 |
| 50 | 50.8 | 16.6 | 6 | 208.2 $k_3$ | 215.3 | 95 |
| 75 | 76.2 | 19.0 | 6 | 381.8 $k_3$ | 267.9 | 96 |
| 100 | 101.6 | 28.5 | 4 | 463.8 $k_3$ | 421.0 | 93 |

The number of reinforcing layers is preferred to be set within a range of four to six or a range of two to eight. In Table 3, if the nominal diameter is 38 mm, the value of $k_3$ is determined by dividing the bend radius 128.3 by the calculated value 152.4 mm (≈0.84). If the nominal diameter is 50 mm, $k_3$ is (≈1.03).

As described above, particularly in the embodiment constructed as described above, the dimension ratio ($\Phi_2/\Phi_1$) of the elastic tube 24 is set within a range of 0.56 to 0.72, and the thickness $\eta$ of the elastic tube 24 is set within a range of 23 to 35 mm. Therefore, when the squeezing rollers 22 start to squeeze the elastic tube 24, the elastic tube 24 is located in the normal squeezing position without being pressed against the inner surface of the drum 11. This structure prevents the elastic tube 24 from being damaged by excessive stress that acts locally thereon. The durability of the tube is thus improved.

The dimension ratio ($\Phi_2/\Phi_1$) may be set within a range of 0.60 to 0.68, which is smaller than the range of 0.56 to 0.72. This facilitates squeezing of the elastic tube 24 at a proper squeezing position. Therefore, the durability of the tube is further improved.

The elastic tube 24 is constituted by the rubber tube body 40 and the reinforcing layers 41 to 44 that are embedded in the body. This structure improves the durability of the elastic tube. Furthermore, the reinforcing layers 41 to 44 are arranged in the tube body 40 with a predetermined interval between one another in the radial direction. The reinforcing layers 41 to 44 extend helically in opposing directions. This further improves the durability of the elastic tube 24.

The reinforcing layers 41 to 44 are formed from the synthetic fiber belts 47. Each synthetic belts 47 includes the plurality of synthetic fibers 45, which are formed from nylon, polyester, or the like. With the synthetic fibers 45 arranged in a row, the rubber 46 encompasses their outer surfaces. This structure also improves the durability of the elastic tube 24.

The thickness $\gamma$, which is defined by the inner surface 243 of the elastic tube 24 and the innermost reinforcing layers, or the first reinforcing layer 41 of the rubber body 40, is set within a range of 10 to 15 mm. This structure prevents the foreign body 48 from cutting the reinforcing layer 41 when the foreign body 48 is caught in the elastic tube. Thus, the durability of the elastic tube 24 is further improved.

The bend radius R is set to enable the compression of the elastic tube to be 90% or larger. The bend radius R is determined by the equation (4). This prevents the buckling of the elastic tube 24, and thus the durability of the tube is improved.

The present invention is not restricted to this embodiment and may be embodied as follows.

Figure 13:
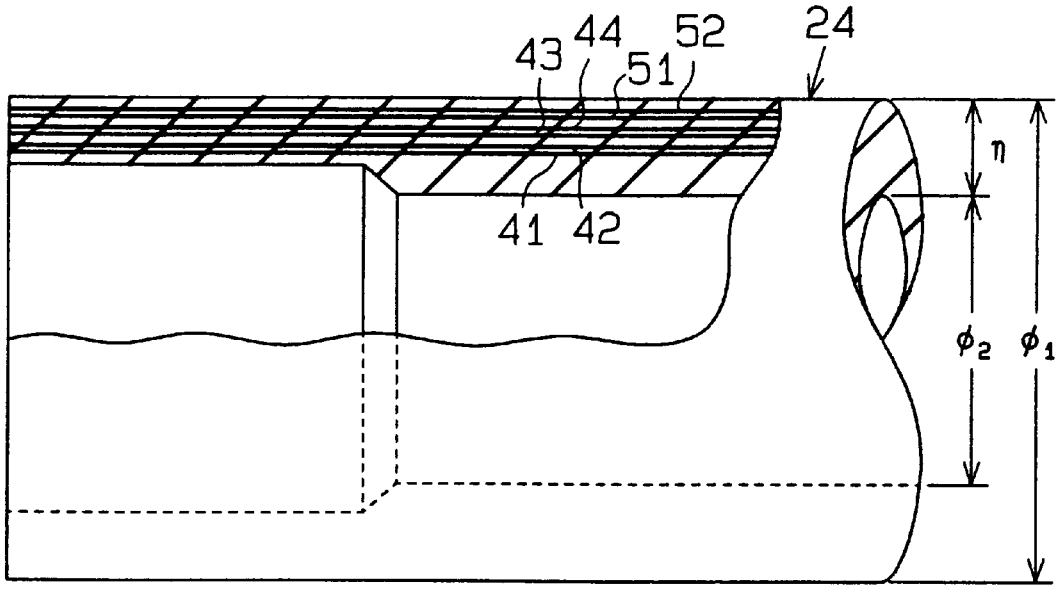
FIG. 13 is a partial cross-sectional side view showing another embodiment of the elastic tube.
Figure 14:
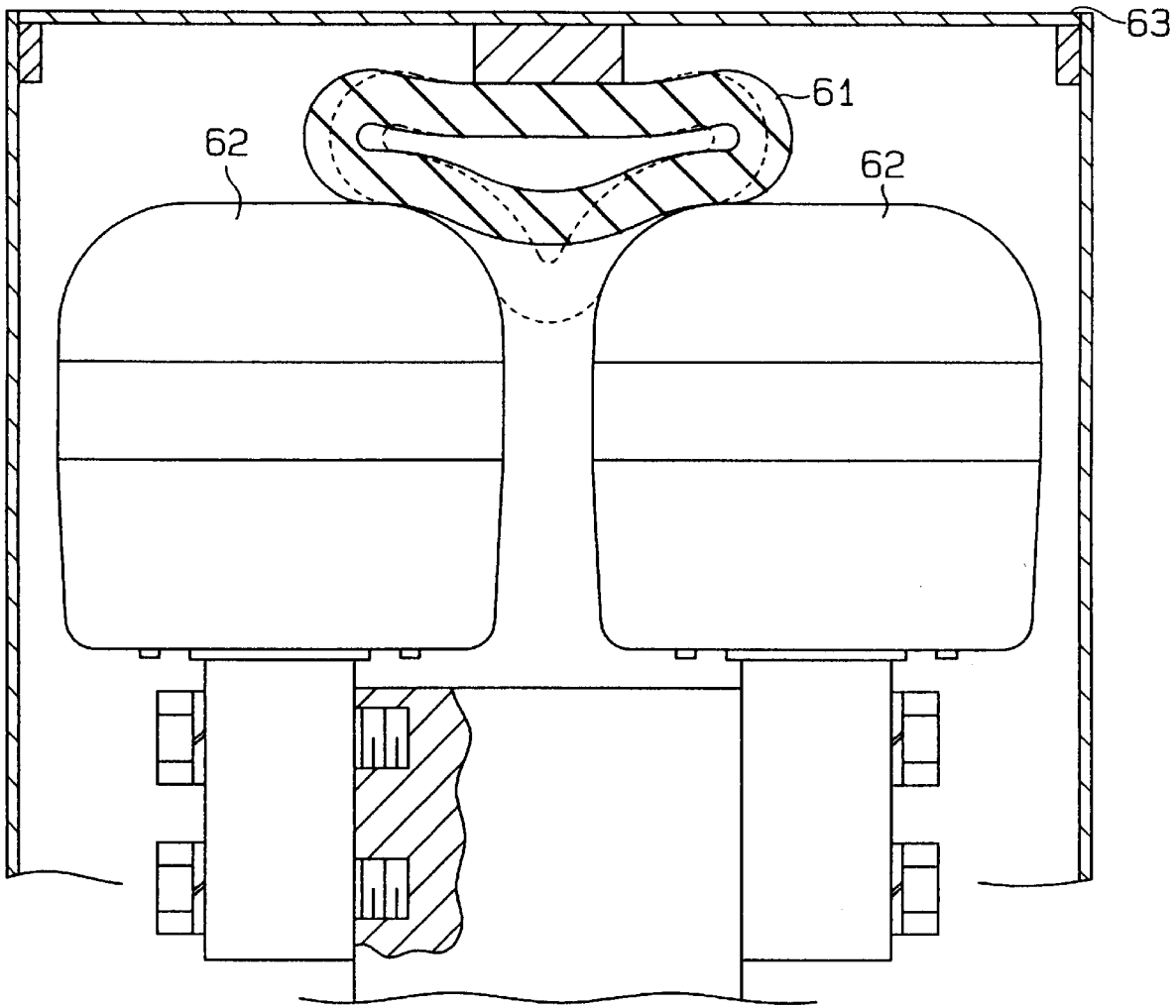
Fig.14(Prior Art)
FIG. 14 is a partial cross-sectional view showing a prior art squeeze type pump.

As shown in FIG. 13, a fifth reinforcing layer 51 and a sixth reinforcing layer 52 may be formed in the elastic tube 24 in addition to the first to fourth reinforcing layers 41 to 44. Alternatively, one, two, three, seven or more reinforcing layers may be formed in the elastic tube 24.

The body 40 of the elastic tube 24 may be formed from nitrile rubber (acrylonitrile-butadiene copolymer), styrene rubber (styrene-butadiene copolymer), acrylic rubber (acrylonitrile-acrylic ester copolymer), polyethylene rubber (chlorosulfonated polyethylene), polyurethane rubber or the like.

The synthetic fibers 45 of the synthetic fiber cords 47 may be formed by twisting a plurality of fibers together.

It should be apparent to those skilled in the art that the present invention may be embodied in many other specific forms without departing from the spirit or scope of the invention.

What is claimed is:

1. A squeeze type pump that transfers slurry via an elastic tube by squeezing the elastic tube with pairs of rollers to elastically deform the tube by moving each pair of squeezing rollers, wherein the elastic tube has an outer diameter, an inner diameter, and a thickness, wherein a ratio of the inner diameter, to the outer diameter is set within a range of 0.56 to 0.72, and the thickness is set within a range of 23 to 35 mm;

the elastic tube including a rubber tube body and reinforcing layers embedded in the tube body, said reinforcing layers including a plurality of threads arranged with an interval between one another and rubber encompassing each thread, the threads being formed from either nylon or polyester.

2. The squeeze type pump as set forth in claim 1, further comprising;

a cylindrical drum, wherein the elastic tube is arranged along an inner surface of the drum;

a drive shaft supported at a center portion of the drum;

pairs of support shafts cantilevered by the drive shaft; and bearings rotatably supporting the rollers on each support shaft.

3. The squeeze type roller as set forth in claim 2, further comprising:

attachment plates mounted on the drive shaft;

a plurality of support arms cantilevered to the mounting plates;

restricting rollers rotatably supported by each support shaft for restricting a position of the elastic tube when engaged with the elastic tube; and restoring rollers attached to the attachment plates for restoring the elastic tube, which was previously compressed by the squeezing rollers.

4. The squeeze type pump as set forth in claim 2, wherein the elastic tube has an oval cross section when arranged along the inner surface of the drum, and wherein the distance from the center of the drum to the axis of the elastic tube, or a bend radius R, is determined by the following equation, so that the ratio of the minor axis ($D_2$) of the oval cross section to the major axis ($D_1$) thereof, or a compression ratio, will be 90% or larger, the equation being $R=k_3\times(\Phi_2+\eta)\times(\Phi_2/\eta)$, and $k_3$ (1/G), wherein G indicates the rigidity of the elastic tube, $\eta$ indicates the thickness of the elastic tube, $\Phi_2$ indicates the inner diameter of the elastic tube when the elastic tube has a round cross-section, and $k_3$ is a constant.

5. The squeeze type pump as set forth in claim 1, wherein the thickness of the elastic tube is set within a range of 28.7 to 30.0 mm.

6. The squeeze type pump as set forth in claim 1, wherein the reinforcing layers are arranged in the tube body with a predetermined radial interval between one another, and the reinforcing layers extend helically in opposite directions.

7. The squeeze type pump as set forth in claim 6, wherein an angle defined by the reinforcing layers and the axis of the tube body is set within a range of about 50 to about 60 degrees.

8. The squeeze type pump as set forth in claim 1, wherein a thickness of the tube body defined between an inner surface of the elastic tube and the reinforcing layers is set within a range of 10 to 15 mm.

9. The squeeze type pump as set forth in claim 1, wherein the tube body is formed from rubber that has wear-resistant and weather-resistant properties, the rubber being formed from materials including 50 parts by weight of natural rubber, 50 parts by weight of styrene-butadiene rubber, 50 parts by weight of carbon black, 5 parts by weight of zinc white, 5 parts by weight of softener, 3 parts by weight of processing aid, 2 parts by weight of sulfur, 1 part by weight of vulcanization accelerator, 2 parts by weight of stearic acid, and 1 part by weight of antioxidant.

10. An elastic tube for a squeeze type pump that transfers slurry via an elastic tube by squeezing the elastic tube with pairs of rollers to elastically deform the tube by moving each pair of squeezing rollers, wherein the elastic tube has an outer diameter, an inner diameter, and a thickness, a ratio of the inner diameter to the outer diameter being set within a range of 0.56 to 0.72, and the thickness being set within a range of 23 to 35 mm;

the elastic tube including a rubber tube body and reinforcing layers embedded in the tube body, said reinforcing layers including a plurality of threads arranged with an interval between one another and rubber encompassing each thread, the threads being formed from either nylon or polyester.

11. The elastic tube as set forth in claim 10, wherein the thickness of the elastic tube is set within a range of 28.7 to 30.0 mm.

12. The elastic tube as set forth in claim 10, wherein the reinforcing layers are arranged in the tube body with a predetermined radial interval between one another, and the reinforcing layers extend helically in opposite directions.

13. The elastic tube as set forth in claim 12, wherein an angle defined by the reinforcing layers and the axis of the tube body is set within a range of about 50 to about 60 degrees.

14. The elastic tube as set forth in claim 10, wherein a thickness of the tube body defined by an inner surface of the elastic tube and the reinforcing layers is set within a range of 10 to 15 mm.

15. The elastic tube as set forth in claim 10, wherein the tube body is formed from rubber that has wear-resistant and weather-resistant properties, the rubber being formed from materials including 50 parts by weight of natural rubber, 50 parts by weight of styrene-butadiene rubber, 50 parts by weight of carbon black, 5 parts by weight of zinc white, 5 parts by weight of softener, 3 parts by weight of processing aid, 2 parts by weight of sulfur, 1 part by weight of vulcanization accelerator, 2 parts by weight of stearic acid, and 1 part by weight of antioxidant.

* * * * *

UNITED STATES PATENT AND TRADEMARK OFFICE

CERTIFICATE OF CORRECTION

PATENT NO. : 6,168,397 B1
DATED : January 2, 2001
INVENTOR(S) : Noboru Iwata

It is certified that error appears in the above-identified patent and that said Letters Patent is hereby corrected as shown below:

Title page,
Item [56], References Cited, FOREIGN PATENT DOCUMENTS section, document number "47-11744" should be -- 47-22744 --.

Column 2,
Line 24, immediately before the word "side", insert -- cross-sectional --.

Column 5,
Line 18, "parellel" should be replace with -- parallel --.
Line 47, "a" should be replace with -- α --.
Lines 56-57, delete " to assure safety".
Line 66, after the word "buckling", insert -- resistance --.

Column 6,
Line 13, please delete the comma that appears after the number 44.
Line 43, after "$k_3$" insert ∝.

Column 7,
Line 48, replace "belts" with -- belt --.

Column 8,
Line 61, after "$k_3$" insert ∝.

Signed and Sealed this

Twenty-third Day of July, 2002

*Attest:*

*Attesting Officer*

JAMES E. ROGAN
*Director of the United States Patent and Trademark Office*